US009605548B2

(12) United States Patent
Zhang et al.

(10) Patent No.: US 9,605,548 B2
(45) Date of Patent: Mar. 28, 2017

(54) NOZZLE ENDWALL FILM COOLING WITH AIRFOIL COOLING HOLES

(71) Applicant: SOLAR TURBINES INCORPORATED, San Diego, CA (US)

(72) Inventors: Luzeng Zhang, San Diego, CA (US); Juan Yin, San Diego, CA (US); Hee Koo Moon, San Diego, CA (US)

(73) Assignee: Sofar Turbines Incorporated, San Diego, CA (US)

( * ) Notice: Subject to any disclaimer, the term of this patent is extended or adjusted under 35 U.S.C. 154(b) by 598 days.

(21) Appl. No.: 14/146,469

(22) Filed: Jan. 2, 2014

(65) Prior Publication Data

US 2015/0184516 A1 Jul. 2, 2015

(51) Int. Cl.

| | |
|---|---|
| ***F01D 9/04*** | (2006.01) |
| ***F01D 9/06*** | (2006.01) |
| ***F01D 5/18*** | (2006.01) |

(52) U.S. Cl.

CPC ..... *F01D 9/065* (2013.01); *F01D 5/187* (2013.01); *F01D 9/041* (2013.01); *F01D 5/186* (2013.01); *F05D 2240/121* (2013.01); *F05D 2240/122* (2013.01); *F05D 2240/123* (2013.01); *F05D 2250/323* (2013.01); *F05D 2260/202* (2013.01)

(58) Field of Classification Search

CPC ..... F01D 5/186; F01D 5/187; F01D 9/041; F01D 25/12; F05D 2240/123; F05D 2240/121; F05D 2260/202

See application file for complete search history.

(56) References Cited

U.S. PATENT DOCUMENTS

| | | | | |
|---|---|---|---|---|
| 3,527,543 | A * | 9/1970 | Howald | F01D 5/186 416/97 R |
| 4,863,348 | A * | 9/1989 | Weinhold | F01D 5/145 415/115 |
| 6,270,317 | B1 * | 8/2001 | Manning | F01D 5/186 416/97 R |
| 6,280,140 | B1 | 8/2001 | Soechting et al. | |
| 6,607,355 | B2 * | 8/2003 | Cunha | F01D 5/18 416/97 R |
| 6,769,865 | B2 * | 8/2004 | Kress | F01D 9/04 415/113 |
| 7,097,417 | B2 | 8/2006 | Liang | |
| 7,581,401 | B2 * | 9/2009 | West | F01D 25/12 60/39.182 |
| 7,946,815 | B2 | 5/2011 | Liang | |
| 8,070,422 | B1 | 12/2011 | Liang | |
| 8,167,557 | B2 | 5/2012 | Elliott et al. | |
| 8,380,338 | B2 | 2/2013 | Miller et al. | |
| 2011/0038708 | A1 | 2/2011 | Butkiewicz | |

* cited by examiner

*Primary Examiner* — Ninh H Nguyen

(74) *Attorney, Agent, or Firm* — Procopio, Cary, Hargreaves & Savitch, LLP

(57) ABSTRACT

A nozzle segment for a nozzle ring of a gas turbine engine is disclosed. The nozzle segment includes an upper endwall, a lower endwall, and an airfoil extending between the upper endwall and the lower endwall. The airfoil includes a pressure side wall, a plurality of inner cooling apertures, and a plurality of outer cooling apertures. The plurality of inner cooling apertures extends through a pressure side wall and is arranged in a first row adjacent the lower endwall. The plurality of outer cooling apertures extends through the pressure side wall and is arranged in a second row adjacent the upper endwall.

18 Claims, 3 Drawing Sheets

NOZZLE ENDWALL FILM COOLING WITH AIRFOIL COOLING HOLES

TECHNICAL FIELD

The present disclosure generally pertains to gas turbine engines, and is more particularly directed toward nozzle segments including film cooling holes in the airfoil for cooling the nozzle endwalls.

BACKGROUND

Gas turbine engines include compressor, combustor, and turbine sections. The turbine section is subject to high temperatures. In particular, the first stages of the turbine section are subject to such high temperatures that the first stages are often cooled with air directed from the compressor and into, inter alia, the nozzle segments and turbine blades.

A portion of the air directed into the nozzle segments may be directed through the walls of the nozzle segment airfoils and along the pressure side surface of the walls to film cool the walls. U.S. Patent App. No. 2011/0038708 to J. Butkiewicz discloses an airfoil including an airfoil body having a pressure surface extendable between radial ends and a fluid path in an airfoil interior defined therein. The pressure surface is formed to further define a passage by which coolant is deliverable from the fluid path in the airfoil interior, in a perimetric direction from the pressure surface for the purpose of cooling a portion on the surface of the radial end.

The present disclosure is directed toward overcoming one or more of the problems discovered by the inventors or that is known in the art.

SUMMARY OF THE DISCLOSURE

A nozzle segment for a nozzle ring of a gas turbine engine is disclosed. The nozzle segment includes an upper endwall, a lower endwall, and airfoil. The airfoil extends between the upper endwall and the lower endwall. The airfoil includes a leading edge, a trailing edge, a pressure side wall, a suction side wall, a plurality of inner cooling apertures, and a plurality of outer cooling apertures. The leading edge extends from the upper endwall to the lower endwall. The trailing edge extends from the upper endwall to the lower endwall distal to the leading edge. The pressure side wall extends from the leading edge to the trailing edge. The suction side wall extends from the leading edge to the trailing edge. The plurality of inner cooling apertures extends through the pressure side wall and is arranged in a first row between the leading edge and the trailing edge adjacent the lower endwall. The plurality of outer cooling apertures extends through the pressure side wall and is arranged in a second row between the leading edge and the trailing edge adjacent the upper endwall.

DETAILED DESCRIPTION

The systems and methods disclosed herein include a nozzle segment for a nozzle ring of a gas turbine engine. In embodiments, the nozzle segment includes an upper endwall, a lower endwall, and one or more airfoils there between. Each airfoil includes a first row of cooling apertures and a second row of cooling apertures through the pressure side wall of the airfoil adjacent the upper endwall and the lower endwall respectively. The cooling apertures in each row are angled horizontally relative to the adjacent endwall. The cooling air exiting the rows of cooling apertures may be directed by secondary flows towards the adjacent endwalls to cool the endwalls and in particular the portions of the endwalls near the pressure side roots and the trailing edge.

Figure 1:
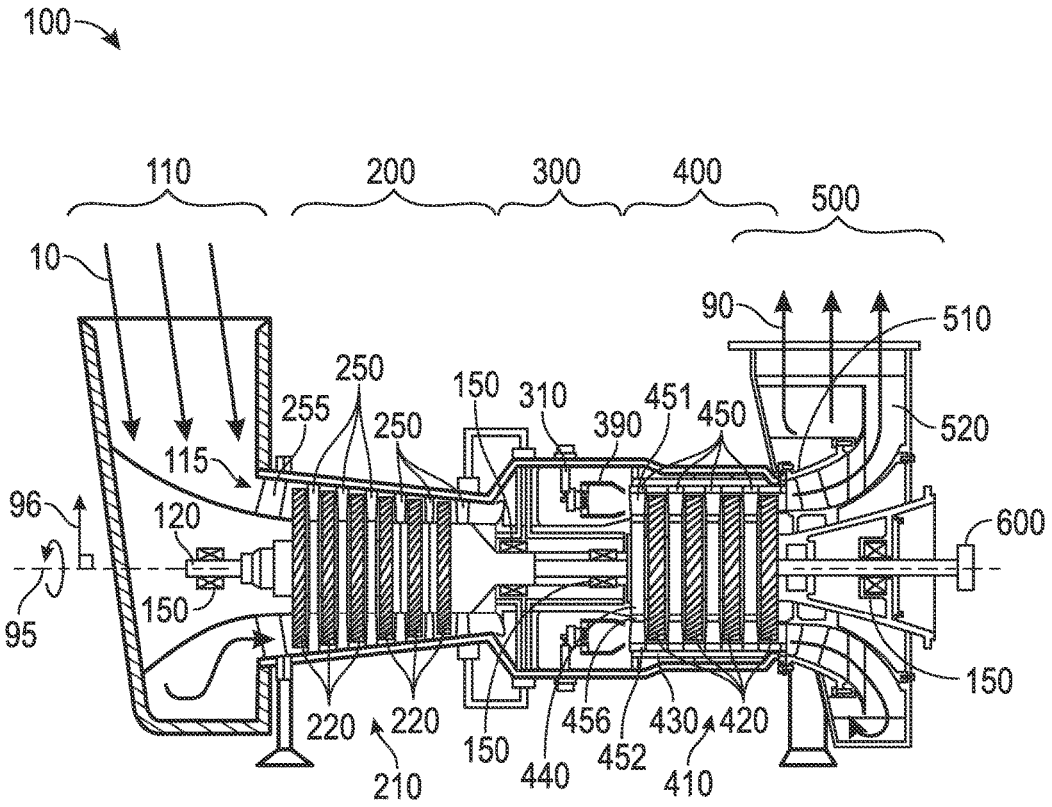
FIG. 1 is a schematic illustration of an exemplary gas turbine engine.

FIG. 1 is a schematic illustration of an exemplary gas turbine engine 100. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

A gas turbine engine 100 includes an inlet 110, a shaft 120, a compressor 200, a combustor 300, a turbine 400, an exhaust 500, and a power output coupling 600. The gas turbine engine 100 may have a single shaft or a dual shaft configuration.

The compressor 200 includes a compressor rotor assembly 210, compressor stationary vanes (stators) 250, and inlet guide vanes 255. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Stators 250 axially follow each of the compressor disk assemblies 220. Each compressor disk assembly 220 paired with the adjacent stators 250 that follow the compressor disk assembly 220 is considered a compressor stage. Compressor 200 includes multiple compressor stages. Inlet guide vanes 255 axially precede the compressor stages.

The combustor 300 includes one or more fuel injectors 310 and includes one or more combustion chambers 390.

The turbine 400 includes a turbine rotor assembly 410 and turbine nozzles 450. The turbine rotor assembly 410 mechanically couples to the shaft 120. As illustrated, the turbine rotor assembly 410 is an axial flow rotor assembly. The turbine rotor assembly 410 includes one or more turbine disk assemblies 420. Each turbine disk assembly 420 includes a turbine disk that is circumferentially populated with turbine blades. A turbine nozzle 450, such as a nozzle ring, axially precedes each of the turbine disk assemblies 420. Each turbine nozzle 450 includes multiple nozzle segments 451 grouped together to form a ring. Each turbine disk assembly 420 paired with the adjacent turbine nozzle 450 that precede the turbine disk assembly 420 is considered a turbine stage. Turbine 400 includes multiple turbine stages.

The turbine 400 may also include a turbine housing 430 and turbine diaphragms 440. Turbine housing 430 may be located radially outward from turbine rotor assembly 410 and turbine nozzles 450. Turbine housing 430 may include one or more cylindrical shapes. Each nozzle segment 451 may be configured to attach, couple to, or hang from turbine housing 430. Each turbine diaphragm 440 may axially precede each turbine disk assembly 420 and may be adjacent a turbine disk. Each turbine diaphragm 440 may also be located radially inward from a turbine nozzle 450. Each nozzle segment 451 may also be configured to attach or couple to a turbine diaphragm 440.

The exhaust 500 includes an exhaust diffuser 510 and an exhaust collector 520. The power output coupling 600 may be located at an end of shaft 120.

Figure 2:
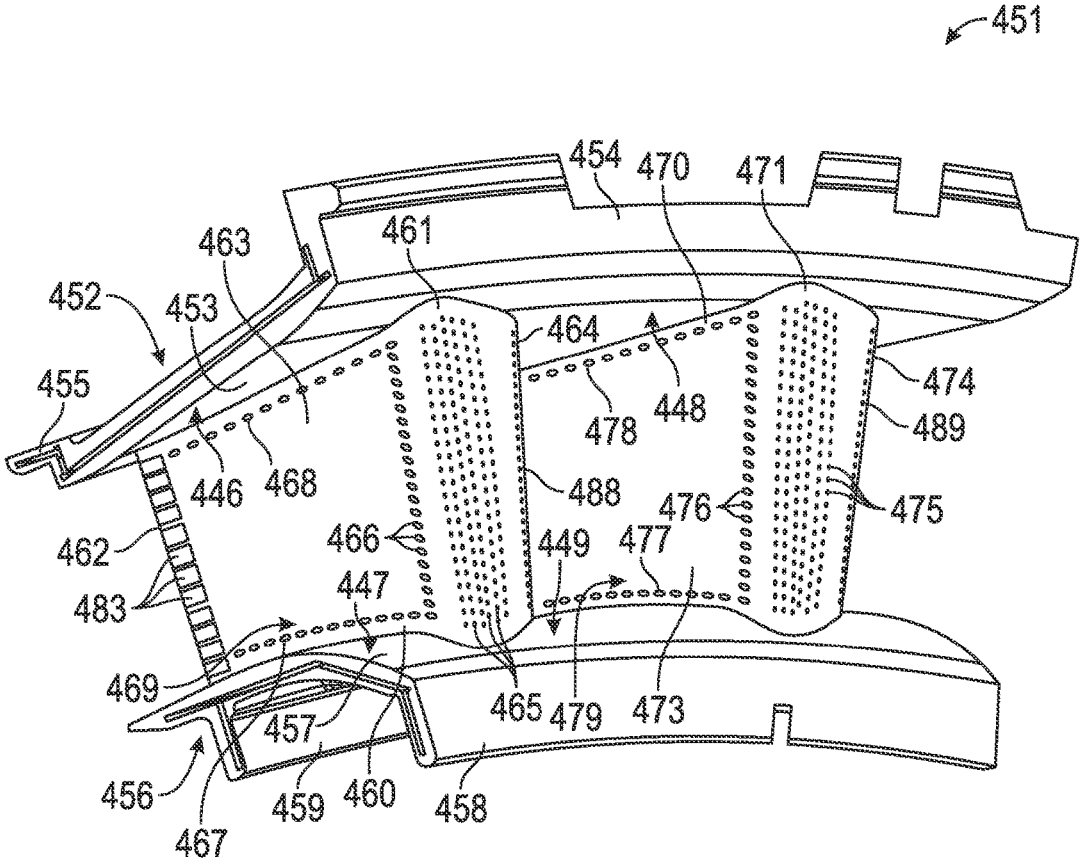
FIG. 2 is a perspective view of a nozzle segment for the gas turbine engine of FIG. 1.

FIG. 2 is a perspective view of a nozzle segment 451 for the gas turbine engine 100 of FIG. 1. Nozzle segment 451 includes upper shroud 452, lower shroud 456, airfoil 460, and second airfoil 470. In other embodiments, nozzle segment 451 can include more or fewer airfoils. Upper shroud 452 may be located adjacent and radially inward from turbine housing 430 when nozzle segment 451 is installed in gas turbine engine 100. Upper shroud 452 includes upper endwall 453. Upper endwall 453 may be a portion of an annular shape, such as a sector. For example, the sector may be a sector of a toroid (toroidal sector) or a sector of a hollow cylinder. The toroidal shape may be defined by a cross-section with an inner edge including a convex shape. Multiple upper endwalls 453 are arranged to form the annular shape, such as a toroid, and to define the radially outer surface of the flow path through a turbine nozzle 450. Upper endwall 453 may be coaxial to center axis 95 when installed in the gas turbine engine 100.

Upper shroud 452 may also include upper forward rail 454 and upper aft rail 455. Upper forward rail 454 extends radially outward from upper endwall 453. In the embodiment illustrated in FIG. 2, upper forward rail 454 extends from upper endwall 453 at an axial end of upper endwall 453. In other embodiments, upper forward rail 454 extends from upper endwall 453 near an axial end of upper endwall 453 and may be adjacent to the axial end of upper endwall 453. Upper forward rail 454 may include a lip, protrusion or other features that may be used to secure nozzle segment 451 to turbine housing 430.

Upper aft rail 455 may also extend radially outward from upper endwall 453. In the embodiment illustrated in FIG. 2, upper aft rail 455 is 'L' shaped, with a first portion extending radially outward from the axial end of upper endwall 453 opposite the location of upper forward rail 454, and a second portion extending in the direction opposite the location of upper forward rail 454 extending axially beyond upper endwall 453. In other embodiments, upper aft rail 455 includes other shapes and may be located near the axial end of upper endwall 453 opposite the location of upper forward rail 454 and may be adjacent to the axial end of upper endwall 453 opposite the location of upper forward rail 454. Upper aft rail 455 may also include other features that may be used to secure nozzle segment 451 to turbine housing 430.

Lower shroud 456 is located radially inward from upper shroud 452. Lower shroud 456 may also be located adjacent and radially outward from turbine diaphragm 440 when nozzle segment 451 is installed in gas turbine engine 100. Lower shroud 456 includes lower endwall 457. Lower endwall 457 is located radially inward from upper endwall 453. Lower endwall 457 may be a portion of an annular shape, such as a sector. For example, the sector may be a sector of a toroid (toroidal sector) or a sector of a hollow cylinder. The toroidal shape may be defined by a cross-section with an outer edge including a convex shape. Multiple lower endwalls 457 are arranged to form the annular shape, such as a toroid, and to define the radially inner surface of the flow path through a turbine nozzle 450. Lower endwall 457 may be coaxial to upper endwall 453 and center axis 95 when installed in the gas turbine engine 100.

Lower shroud 456 may also include lower forward rail 458 and lower aft rail 459. Lower forward rail 458 extends radially inward from lower endwall 457. In the embodiment illustrated in FIG. 2, lower forward rail 458 extends from lower endwall 457 at an axial end of lower endwall 457. In other embodiments, lower forward rail 458 extends from lower endwall 457 near an axial end of lower endwall 457 and may be adjacent lower endwall 457 near the axial end of lower endwall 457. Lower forward rail 458 may include a lip, protrusion or other features that may be used to secure nozzle segment 451 to turbine diaphragm 440.

Lower aft rail 459 may also extend radially inward from lower endwall 457. In the embodiment illustrated in FIG. 2, lower aft rail 459 extends from lower endwall 457 near the axial end of lower endwall 457 opposite the location of lower forward rail 458 and may be adjacent the axial end of lower endwall 457 opposite the location of lower forward rail 458. In other embodiments, lower aft rail 459 extends from the axial end of lower endwall 457 opposite the location of lower forward rail 458. Lower aft rail 459 may also include a lip, protrusion or other features that may be used to secure nozzle segment 451 to turbine diaphragm 440.

Airfoil 460 extends between upper endwall 453 and lower endwall 457. Airfoil 460 includes leading edge 461, trailing edge 462, pressure side wall 463, and suction side wall 464. Leading edge 461 extends from upper endwall 453 adjacent an axial end of upper endwall 453 to lower endwall 457 adjacent an axial end of lower endwall 457. Leading edge 461 may be located near upper forward rail 454 and lower forward rail 458. Trailing edge 462 may extend from upper endwall 453 axially offset from and distal to leading edge 461, adjacent the axial end of upper endwall 453 opposite the location of leading edge 461 and from lower endwall 457 adjacent the axial end of upper endwall 453 opposite and axially distal to the location of leading edge 461. When nozzle segment 451 is installed in gas turbine engine 100, leading edge 461, upper forward rail 454, and lower forward rail 458 may be located axially forward and upstream of trailing edge 462, upper aft rail 455, and lower aft rail 459. Leading edge 461 may be the point at the upstream end of airfoil 460 with the maximum curvature and trailing edge 462 may be the point at the downstream end of airfoil 460 with maximum curvature. In the embodiment illustrated in FIG. 1, nozzle segment 451 is part of the first stage turbine nozzle 450 adjacent combustion chamber 390. In other embodiments, nozzle segment 451 is located within a turbine nozzle 450 of another stage.

Pressure side wall 463 may span or extend from leading edge 461 to trailing edge 462 and from upper endwall 453 to lower endwall 457. Pressure side wall 463 may include a concave shape. Pressure side wall 463 may also include a pressure side surface 469, the outer surface of pressure side wall 463, with a concave shape. Suction side wall 464 may also span or extend from leading edge 461 to trailing edge 462 and from upper endwall 453 to lower endwall 457. Suction side wall 464 may include a convex shape. Leading edge 461, trailing edge 462, pressure side wall 463 and suction side wall 464 may form a cooling cavity 485 (illustrated in FIG. 3) there between. Upper endwall 453, lower endwall 457, or both may include one or more pathways for cooling air (not shown) to enter the cooling cavity 485, such as a hole or holes.

Airfoil 460 includes multiple cooling holes or apertures. Each cooling hole or aperture may be a channel extending through a wall of the airfoil 460, such as the pressure side wall 463. Airfoil 460 includes inner cooling apertures 467 and outer cooling apertures 468. Inner cooling apertures 467 are adjacent lower endwall 457, such as adjacent the intersection between lower endwall 457 and pressure side wall 463, and are arranged in a row between the leading edge 461 and the trailing edge 462. The row of inner cooling apertures 467 may extend or span between the leading edge 461 and the trailing edge 462. The row of inner cooling apertures 467 may include from ten to thirty inner cooling apertures 467. In the embodiment illustrated in FIG. 2, the row of inner cooling apertures 467 includes twelve inner cooling apertures 467. The row of inner cooling apertures 467 may be parallel to the lower endwall 457 and/or may match the curvature of the lower endwall 457. The row of inner cooling apertures 467 may be configured to cool a portion of the lower endwall surface 447 adjacent pressure side wall 463.

In one embodiment, adjacent inner cooling apertures 467 are spaced apart from three to five pitch over diameter, the distance between the centers of adjacent apertures over the diameter of the apertures. In another embodiment, adjacent inner cooling apertures 467 are spaced apart by at least three pitch over diameter. In yet another embodiment, adjacent inner cooling apertures 467 are spaced apart up to five pitch over diameter. In other embodiments, adjacent inner cooling apertures 467 may be spaced apart below three pitch over diameter and above five pitch over diameter.

In one embodiment, each inner cooling aperture 467 may be radially spaced apart from lower endwall 457 from three to seven times the diameter of the inner cooling aperture 467. In another embodiment, each inner cooling aperture 467 is radially spaced apart from lower endwall 457 by at least three times the diameter of the inner cooling aperture 467. In yet another embodiment, each inner cooling aperture 467 is radially spaced apart from lower endwall 457 up to seven times the diameter of the inner cooling aperture 467. In other embodiments, each inner cooling aperture 467 may be radially spaced apart from lower endwall 457 below three times and above seven times the diameter of the inner cooling aperture 467.

Similarly, outer cooling apertures 468 are adjacent upper endwall 453, such as adjacent the intersection between upper endwall 453 and pressure side wall 463, and are arranged in a row between the leading edge 461 and the trailing edge 462. The row of outer cooling apertures 468 may extend or span between the leading edge 461 and the trailing edge 462. The row of outer cooling apertures 468 may include from ten to thirty outer cooling apertures 468. In the embodiment illustrated in FIG. 2, the row of outer cooling apertures 468 includes twelve outer cooling apertures 468. The row of outer cooling apertures 468 may be parallel to the upper endwall 453 and/or may match the curvature of the upper endwall 453. The row of outer cooling apertures 468 may be configured to cool a portion of the upper endwall surface 446 adjacent pressure side wall 463.

In one embodiment, adjacent outer cooling apertures 468 are spaced apart from three to five pitch over diameter, the distance between the centers of adjacent apertures over the diameter of the apertures. In another embodiment, adjacent outer cooling apertures 468 are spaced apart by at least three pitch over diameter. In yet another embodiment, adjacent outer cooling apertures 468 are spaced apart up to five pitch over diameter. In other embodiments, adjacent outer cooling apertures 468 may be spaced apart below three pitch over diameter and above five pitch over diameter.

In one embodiment, each outer cooling aperture 468 may be radially spaced apart from upper endwall 453 from three to seven times the diameter of the outer cooling aperture 468. In another embodiment, each outer cooling aperture 468 is radially spaced apart from upper endwall 453 by at least three times the diameter of the outer cooling aperture 468. In yet another embodiment, each outer cooling aperture 468 is radially spaced apart from upper endwall 453 up to seven times the diameter of the outer cooling aperture 468. In other embodiments, each outer cooling aperture 468 may be radially spaced apart from upper endwall 453 below three times and above seven times the diameter of the outer cooling aperture 468.

In one embodiment, each inner cooling aperture 467 and each outer cooling aperture 468 may include a diameter from 0.50 millimeters (0.02 inches) to 1.25 millimeters (0.05 inches). In another embodiment, each inner cooling aperture 467 and each outer cooling aperture 468 is at least 0.50 millimeters (0.02 inches). In yet another embodiment, each inner cooling aperture 467 and each outer cooling aperture 468 is up to 1.25 millimeters (0.05 inches).

Airfoil 460 may also include showerhead cooling apertures 465, angled cooling apertures 466, and suction side cooling apertures 488. Showerhead cooling apertures 465 may be located at leading edge 461 and may be arranged in a group, such as grouped together along leading edge 461, the group extending between upper endwall 453 and lower endwall 457. Showerhead cooling apertures 465 may be arranged in columns. In the embodiment shown in FIG. 2, showerhead cooling apertures 465 are arranged in six columns, each column extending in the radial direction between upper endwall 453 and lower endwall 457. In other embodiments, showerhead cooling apertures 465 may be arranged in four to seven columns or may be arranged in other configurations. The portions of pressure side wall 463 and suction side wall 464 adjacent leading edge 461 may include showerhead cooling apertures 465 or columns of showerhead cooling apertures 465. In some embodiments, showerhead cooling apertures 465 are spaced apart from 3 to 4 pitch over diameter. In other embodiments, showerhead cooling apertures 465 are spaced apart at 3.5 pitch over diameter. Each showerhead cooling aperture 465 may include a diameter from 0.38 millimeters (0.015 inches) to 1.25 millimeters (0.05 inches).

Angled cooling apertures 466 may be grouped together and may be located ahead of, behind, or between the rows of inner cooling apertures 467 and outer cooling apertures 468. In the embodiment illustrated in FIG. 2, angled cooling apertures 466 are proximate showerhead cooling apertures 465 and are located from ⅛ to ¼ of the length of pressure side wall 463 from showerhead cooling apertures 465. In the embodiment illustrated in FIG. 2, angled cooling apertures 466 are arranged in a single radial column and spaced apart radially at 3.5 pitch over diameter. In other embodiments, angled cooling apertures 466 are spaced apart radially from 3 to 4 pitch over diameter. Each angled cooling aperture 466 may include a diameter from 0.38 millimeters (0.015 inches) to 1.25 millimeters (0.05 inches).

Suction side cooling apertures 488 may be configured in a column along suction side wall 464. Each suction side cooling aperture 488 may be a channel extending through suction side wall 464 and may be angled to direct cooling air along the surface of suction side wall 464.

Airfoil 460 may further include slots 483. Slots 483 may be located on pressure side wall 463 and may be adjacent trailing edge 462. Slots 483 may be rectangular and may be aligned in the radial direction between upper endwall 453 and lower endwall 457. Slots 483 may extend from cooling cavity 485 (shown in FIG. 3) to trailing edge 462.

In the embodiment illustrated in FIG. 2, nozzle segment 451 includes second airfoil 470. Second airfoil 470 may be circumferentially offset from airfoil 460. Second airfoil 470 may include the same or similar features as airfoil 460 including second leading edge 471, second trailing edge (not shown), second pressure side wall 473, and second suction side wall 474. Second airfoil 470 may further include second inner cooling apertures 477, second outer cooling apertures 478, second showerhead cooling apertures 475, second angled cooling apertures 476, and second slots (not shown). The description of second leading edge 471, the second trailing edge, second pressure side wall 473, second suction side wall 474, second inner cooling apertures 477, second outer cooling apertures 478, second showerhead cooling apertures 475, second angled cooling apertures 476, second suction side cooling apertures 489, and the second slots may be oriented in the same or a similar manner as leading edge 461, trailing edge 462, pressure side wall 463, suction side wall 464, inner cooling apertures 467, outer cooling apertures 468, showerhead cooling apertures 465, angled cooling apertures 466, suction side cooling apertures 488, and slots 483 respectively. The row of second inner cooling apertures 477 may be configured to cool a second portion of the lower endwall surface 449, which may be located between airfoil 460 and second airfoil 470. The row of second outer cooling apertures 478 may be configured to cool a second portion of the upper endwall surface 448, which may be located between airfoil 460 and second airfoil 470.

In other embodiments, nozzle segment 451 only includes airfoil 460 and not second airfoil 470.

The various components of nozzle segment 451 including upper shroud 452, lower shroud 456, airfoil 460, and second airfoil 470 may be integrally cast or metalurgically bonded to form a unitary, one piece assembly thereof.

Figure 3:
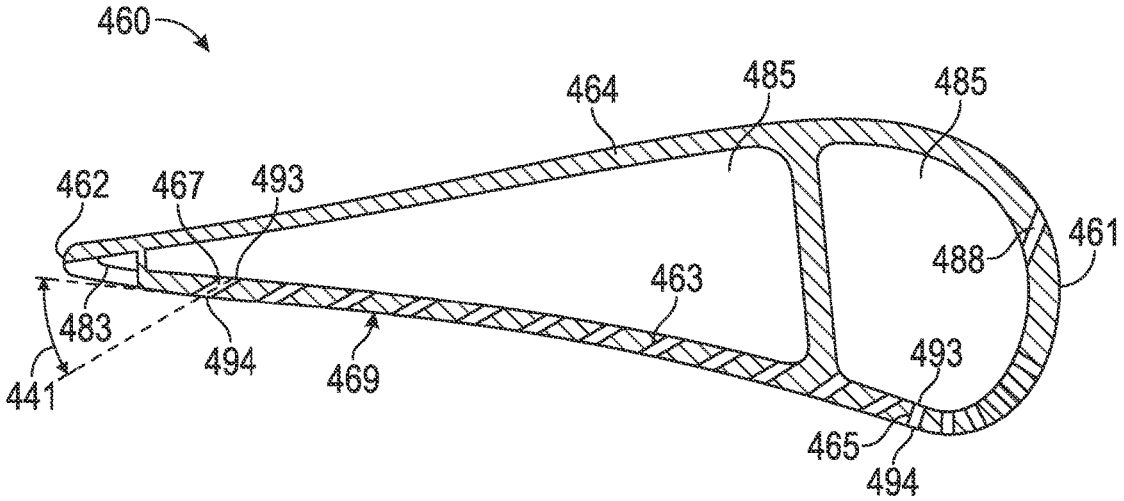
FIG. 3 is a cross-section of the airfoil of FIG. 2.

FIG. 3 is a cross-section of the airfoil 460 of FIG. 2. Referring to FIG. 3, each inner cooling aperture 467 and outer cooling aperture 468 (not shown in FIG. 3) includes an injection angle 441 located in the plane perpendicular to pressure side surface 469. Injection angle 441 may be measured relative to a line extending toward trailing edge 462 and tangent to pressure side surface 469 at the location of each inner cooling aperture 467 or outer cooling aperture 468. In one embodiment, injection angle 441 is from fifteen to fifty degrees. In another embodiment, injection angle 441 is approximately thirty degrees.

Each cooling aperture may include an inlet end 493 adjacent cooling cavity 485 and an outlet end 494 adjacent either pressure side surface 469 or leading edge 461. Cooling cavity 485 may be a single cavity or may be subdivided into multiple cavities. In the embodiment illustrated in FIG. 3, cooling cavity 485 is subdivided into two cooling cavities.

Figure 4:
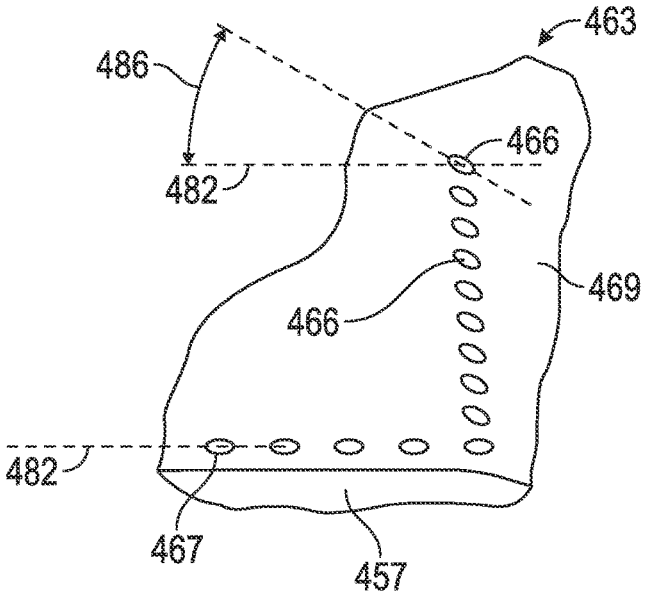
FIG. 4 is a detailed view of a portion of the airfoil of FIG. 2.

FIG. 4 is a detailed view of a portion of the airfoil 460 of FIG. 2. Referring to FIG. 4, each inner cooling aperture 467 and outer cooling aperture 468 (not shown in FIG. 4) may include a compound angle that is aligned with the flow direction of the air traveling through the turbine nozzle 450 and/or that is parallel to the lower endwall 457 and the upper endwall 453 respectively. The compound angle may be the component of the angle of each inner cooling aperture 467 and each outer cooling aperture 468 in the plane of pressure side surface 469. Reference line 482 illustrates the flow direction. Reference line 482 may also be defined as the intersection between pressure side surface 469 and a plane perpendicular to a radial extending from the turbine nozzle axis, the axis of upper shroud 452 and lower shroud 456, along the pressure side surface 469. In some embodiments, the compound angle of each inner cooling aperture 467 and each outer cooling aperture 468 may be angled slightly towards the lower endwall 457 and the upper endwall 453 respectively, and may be up to fifteen degrees relative to the flow direction or relative to the angle of the lower endwall 457 or the upper endwall 453 respectively. In another embodiment the compound angle of each inner cooling aperture 467 and each outer cooling aperture 468 may be within plus or minus five degrees relative to the flow direction or relative to the angle of the lower endwall 457 or the upper endwall 453 respectively. In yet other embodiments, the compound angle of each inner cooling aperture 467 and each outer cooling aperture 468 is parallel to the lower endwall 457 and the upper endwall 453 respectively, such as being within a predetermined tolerance of parallel to the lower endwall 457 and the upper endwall 453 respectively.

Angled cooling apertures 466 may also be angled relative to the flow direction of the air traveling through turbine nozzle 450 along pressure side surface 469 during operation of gas turbine engine 100 at a second compound angle 486. Second compound angle 486 may be the component of the angle of angled cooling apertures 466 in the plane of pressure side surface 469. As illustrated, Second compound angle 486 is angled toward upper endwall 453 relative to the flow direction or reference line 482. In one embodiment, second compound angle 486 is from fifteen to forty-five degrees. In another embodiment, second compound angle 486 is thirty degrees, such as within a predetermined tolerance of thirty degrees. The predetermined tolerance may be the engineering tolerance or the manufacturing tolerance. Zero degrees may be the flow direction of the direction along reference line 482 traveling from leading edge 461 to trailing edge 462. While second compound angle 486 is directed towards upper endwall 453 in the embodiment illustrated, second compound angle 486 may directed towards lower endwall 457.

Showerhead cooling apertures 465 may also include a compound angle and may be angled towards either upper endwall 453 or lower endwall 457. Each showerhead cooling aperture 465 may be angled at a showerhead compound angle towards the lower endwall 457 or the upper endwall 453 relative to the direction normal to leading edge 461 at the location where the showerhead cooling aperture 465 is located.

Angled cooling apertures 466 and showerhead cooling apertures 465 may alternate in directionality, being angled or partially angled in opposite radial directions at lower endwall 457 or upper endwall 453. The directionality or angle of the apertures directs cooling air in a selected direction. In one embodiment, showerhead cooling apertures 465 are angled toward lower endwall 457 and angled cooling apertures 466 are angled toward upper endwall 453. In other embodiments, showerhead cooling apertures 465 are angled toward upper endwall 453 and angled cooling apertures 466 are angled toward lower endwall 457. The compound angle for the showerhead cooling apertures 465 may be from twenty to forty-five degrees.

The compound angles may be determined by the positions of the inlet ends 493 and the outlet ends 494 of the cooling apertures relative to lower endwall 457 and upper endwall 453, while the injection angle 441 may be determined by the positions of the inlet ends 493 and the outlet ends 494 relative to leading edge 461 and trailing edge 462.

The inlet end 493 and outlet end 494 of each inner cooling aperture 467 may be equidistant to the lower endwall 457 and the inlet end 493 and outlet end 494 of each outer cooling aperture 468 may be equidistant to the upper endwall 453. The inlet end 493 of each angled cooling aperture 466 and each showerhead cooling aperture 465 may be either radially closer or radially farther from lower endwall 457 than the outlet end 494 of each angled cooling aperture 466 and each showerhead cooling aperture 465. The inlet end 493 of each inner cooling aperture 467, each outer cooling aperture 468, and each angled cooling apertures 466 may be axially closer to leading edge 461 than the outlet end 494 of each inner cooling aperture 467, each outer cooling aperture 468, and each angled cooling apertures 466.

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, alloy x, INCONEL, WASPALOY, RENE alloys, HAYNES alloys, alloy 188, alloy 230, INCOLOY, MP98T, TMS alloys, and CMSX single crystal alloys.

INDUSTRIAL APPLICABILITY

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor disk assemblies 220. In particular, the air 10 is compressed in numbered "stages", the stages being associated with each compressor disk assembly 220. For example, "4th stage air" may be associated with the 4th compressor disk assembly 220 in the downstream or "aft" direction, going from the inlet 110 towards the exhaust 500). Likewise, each turbine disk assembly 420 may be associated with a numbered stage.

Once compressed air 10 leaves the compressor 200, it enters the combustor 300, where it is diffused and fuel is added. Air 10 and fuel are injected into the combustion chamber 390 via fuel injector 310 and combusted. Energy is extracted from the combustion reaction via the turbine 400 by each stage of the series of turbine disk assemblies 420. Exhaust gas 90 may then be diffused in exhaust diffuser 510, collected and redirected. Exhaust gas 90 exits the system via an exhaust collector 520 and may be further processed (e.g., to reduce harmful emissions, and/or to recover heat from the exhaust gas 90).

Operating efficiency of a gas turbine engine generally increases with a higher combustion temperature. Thus, there is a trend in gas turbine engines to increase the combustion temperatures. Gas reaching forward stages of a turbine from a combustion chamber 390 may be 1000 degrees Fahrenheit or more. To operate at such high temperatures a portion of the compressed air 10 from the compressor 200, cooling air, may be diverted through internal passages or chambers to cool various components of a turbine including nozzle segments such as nozzle segment 451. However, the use of cooling air may reduce the operating efficiency of the gas turbine engine.

Referring to FIG. 2, the amount of cooling air used to cool a nozzle segment 451 and the complexity of the cooling passages through the nozzle segment 451 may be reduced by directing cooling air through the inner cooling apertures 467 and outer cooling apertures 468. The first order of cooling or initial use of the cooling air exiting inner cooling apertures 467 and outer cooling apertures 468 may be to film cool pressure side wall 463.

A secondary airflow through the nozzle segment 451 may carry or direct the cooling air exiting the inner cooling apertures 467 to the surface of lower endwall 457, such as the portion of the lower endwall surface 447, adjacent the intersection between the airfoil 460 and the lower endwall 457 or inner root of airfoil 460 and to the surface of lower endwall 457 adjacent the trailing edge 462 for a second order of cooling or second use of the cooling air. Similarly, a secondary airflow through the nozzle segment 451 may carry or direct the cooling air exiting the outer cooling apertures 468 to the surface of upper endwall 453, such as the portion of the upper endwall surface 446, adjacent the intersection between the airfoil 460 and the upper endwall 453 or inner root of airfoil 460 and to the surface of upper endwall 453 adjacent the trailing edge 462 for a second order of cooling or second use of the cooling air.

Alternating the direction of the showerhead cooling apertures 465 and the angled cooling apertures 466 may direct cooling air towards upper endwall 453 of upper shroud 452 and lower endwall 457 of lower shroud 456 and may further reduce the temperatures of upper endwall 453 and lower endwall 457, which may further improve the operating life of nozzle segment 451. Similar to the use of cooling air exiting the inner cooling apertures 467 and the outer cooling apertures 468, the first order cooling for the showerhead cooling apertures 465 and angled cooling apertures 466 may be to film cool pressure side wall 463, while the second order cooling may be to further reduce the temperatures of upper endwall 453 and lower endwall 457.

The cooling air may be directed through turbine housing 430, turbine diaphragm 440, or both and into cooling cavity 485. The cooling air may then be directed through the cooling apertures including inner cooling apertures 467, outer cooling apertures 468, showerhead cooling apertures 465, and angled cooling apertures 466. The cooling air may also be used for cooling airfoil 460 internally prior to passing through the cooling apertures. The multiple uses of the cooling air that may include the first order film cooling, the second order endwall cooling, and the internal cooling may reduce the amount of cooling air needed to effectively cool nozzle segment 451. Reducing the amount of cooling air needed to cool nozzle segment 451 may improve and increase the efficiency of gas turbine engine 100.

The use of cooling air from the inner cooling apertures 467 and the outer cooling apertures 468 to cool the lower endwall 457 and upper endwall 453 may also reduce the number of cooling apertures needed in the nozzle segment 451. Nozzle segment 451 may not require any or may require a limited number of cooling apertures through the lower endwall 457 and the upper endwall 453 to cool the lower endwall 457 and the upper endwall 453 since the cooling may be accomplished by the inner cooling apertures 467 and the outer cooling apertures 468.

The cooling apertures of second airfoil 470 may be used in the same or a similar manner as the cooling apertures of airfoil 460 resulting in a further reduction of the temperatures of upper endwall 453 and lower endwall 457, as well as the reduction in the amount of cooling air needed to effectively cool each nozzle segment 451.

The preceding detailed description is merely exemplary in nature and is not intended to limit the invention or the application and uses of the invention. The described embodiments are not limited to use in conjunction with a particular type of gas turbine engine. Hence, although the present disclosure, for convenience of explanation, depicts and describes a particular nozzle segment, it will be appreciated that the nozzle segment in accordance with this disclosure can be implemented in various other configurations, can be used with various other types of gas turbine engines, and can be used in other types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. A nozzle segment for a nozzle ring of a gas turbine engine, the nozzle segment comprising:

an upper endwall;

a lower endwall; and an airfoil extending between the upper endwall and the lower endwall, the airfoil including a leading edge extending from the upper endwall to the lower endwall, a trailing edge extending from the upper endwall to the lower endwall distal to the leading edge, a pressure side wall extending from the leading edge to the trailing edge, a suction side wall extending from the leading edge to the trailing edge, a plurality of inner cooling apertures extending through the pressure side wall and arranged in a first row between the leading edge and the trailing edge adjacent the lower endwall, and a plurality of outer cooling apertures extending through the pressure side wall and arranged in a second row between the leading edge and the trailing edge adjacent the upper endwall, a plurality of showerhead cooling apertures extending through the leading edge and arranged in a first group extending between the upper endwall and the lower endwall, each showerhead cooling aperture of the plurality of showerhead cooling apertures including a showerhead compound angle from twenty to forty-five degrees, and a plurality of angles cooling apertures extending through the pressure side wall and arranged in a second group extending between the plurality of inner cooling apertures and the plurality of outer cooling apertures, each angled cooling aperture of the plurality of angled cooling apertures including a compound angle from fifteen to forty-five degrees wherein the plurality of showerhead cooling apertures and the plurality of angled cooling apertures alternate in directionality such that the showerhead compound angle and the compound angle are in opposite radial directions.

2. The nozzle segment of claim 1, wherein each inner cooling aperture of the plurality of inner cooling apertures is spaced apart from the lower endwall up to seven times the diameter of the inner cooling aperture and each outer cooling aperture of the plurality of outer cooling apertures is spaced apart from the upper endwall up to seven times the diameter of the outer cooling aperture.

3. The nozzle segment of claim 1, wherein the first row is parallel to the lower endwall and the second row is parallel to the upper endwall.

4. The nozzle segment of claim 1, wherein each inner cooling aperture of the plurality of inner cooling apertures is spaced apart from an adjacent inner cooling aperture of the plurality of inner cooling apertures from three to five pitch over diameter and each outer cooling aperture of the plurality of outer cooling apertures is spaced apart from an adjacent outer cooling aperture of the plurality of outer cooling apertures from three to five pitch over diameter.

5. The nozzle segment of claim 1, wherein each inner cooling aperture of the plurality of inner cooling apertures and each outer cooling aperture of the plurality of outer cooling apertures includes a diameter of at least 0.5 millimeters.

6. The nozzle segment of claim 1, wherein each inner cooling aperture of the plurality of inner cooling apertures and each outer cooling aperture of the plurality of outer cooling apertures includes an injection angle from fifteen degrees to fifty degrees.

7. A gas turbine engine including the nozzle segment of claim 1, wherein the nozzle segment is located in a first stage turbine nozzle of the gas turbine engine.

8. A nozzle segment for a nozzle ring of a gas turbine engine, the nozzle segment comprising:

an upper endwall including a first toroidal sector shape;

a lower endwall located radially inward from and coaxial to the upper endwall, the lower endwall including a second toroidal sector shape; and an airfoil extending radially between the upper endwall and the lower endwall, the airfoil including a leading edge extending radially from the upper endwall to the lower endwall, a trailing edge extending radially from the upper endwall to the lower endwall distal to the leading edge, a pressure side wall extending from the leading edge to the trailing edge, the pressure side wall including a pressure side surface, the outer surface of the pressure side wall, a suction side wall extending from the leading edge to the trailing edge, the leading edge, the trailing edge, the pressure side wall, and the suction side wall forming a cooling cavity there between, a plurality of inner cooling apertures arranged in a first row between the leading edge and the trailing edge adjacent the lower endwall and matching the curvature of the lower endwall, each inner cooling aperture of the plurality of inner cooling apertures extending from the cooling cavity to the pressure side surface at a first injection angle from fifteen to fifty and at a first compound angle up to fifteen degrees, and a plurality of outer cooling apertures arranged in a second row between the leading edge and the trailing edge adjacent the upper endwall and matching the curvature of the upper endwall, each outer cooling aperture of the plurality of outer cooling apertures extending from the cooling cavity to the pressure side surface at a second injection angle from fifteen to fifty and at a second compound angle up to fifteen degrees;

a plurality of showerhead cooling apertures extending through the leading edge and arranged in a first group extending between the upper endwall and the lower endwall, each showerhead cooling aperture of the plurality of showerhead cooling apertures including a showerhead compound angle from twenty to forty-five degrees, and a plurality of angled cooling apertures extending through the pressure side wall and arranged in a second group extending between the plurality of inner cooling apertures and the plurality of outer cooling apertures, each angled cooling aperture of the plurality of angled cooling apertures including a compound angle from fifteen to forty-five degrees, wherein the plurality of showerhead cooling apertures and the plurality of angled cooling apertures alternate in directionality such that the showerhead compound angle and the compound angle are in opposite radial directions.

9. The nozzle segment of claim 8, wherein the first row is offset from the lower endwall up to five diameters of one of the plurality of inner cooling apertures and the second row is offset from the upper endwall up to five diameters of one of the plurality of outer cooling apertures.

10. The nozzle segment of claim 8, wherein each inner cooling aperture of the plurality of inner cooling apertures is spaced apart from an adjacent inner cooling aperture of the plurality of inner cooling apertures by at least three pitch over diameter and each outer cooling aperture of the plurality of outer cooling apertures is spaced apart from an adjacent outer cooling aperture of the plurality of outer cooling apertures by at least three pitch over diameter.

11. A gas turbine engine including the nozzle segment of claim 8, wherein the nozzle segment is located in a first stage turbine nozzle of the gas turbine engine.

12. A nozzle segment for a nozzle ring of a gas turbine engine, the nozzle segment comprising:

an upper endwall including a first annular sector shape;

a lower endwall located radially inward from the upper endwall, the lower endwall including a second annular sector shape; and a first airfoil extending radially between the upper endwall and the lower endwall, the first airfoil including a first leading edge extending from the upper endwall to the lower endwall, a first trailing edge extending from the upper endwall to the lower endwall axially offset from the first leading edge, a first pressure side wall extending from the first leading edge to the first trailing edge with a first concave shape and extending from the upper endwall to the lower endwall, a first suction side wall extending from the first leading edge to the first trailing edge with a first convex shape and extending from the upper endwall to the lower endwall, a first plurality of inner cooling apertures extending through the first pressure side wall and arranged in a first row extending between the first leading edge and the first trailing edge located radially outward from the lower endwall from three to seven times a diameter of one of the first plurality of inner cooling apertures, and a first plurality of outer cooling apertures extending through the first pressure side wall and arranged in a second row extending between the first leading edge and the first trailing edge located radially inward from the upper endwall from three to seven times a second diameter of one of the first plurality of outer cooling apertures, a first plurality of showerhead cooling apertures extending through the first leading edge and arranged in a first group extending between the upper endwall and the lower endwall, each showerhead cooling aperture of the first plurality of showerhead cooling apertures including a showerhead compound angle from twenty to forty-five degrees, and a first plurality of angled cooling apertures extending through the first pressure side wall and arranged in a second group extending between the first plurality a inner cooling apertures and the first plurality of outer cooling apertures, each angled cooling aperture of the first plurality of angled cooling apertures including a compound angle from fifteen to forty-five degrees, wherein the first plurality of showerhead cooling apertures and the first plurality of angled cooling apertures alternate in directionality such that the showerhead compound angle and the compound angle are in opposite radial directions; and a second airfoil extending radially between the upper endwall and the lower endwall circumferentially offset from the first airfoil, the second airfoil including a second leading edge extending from the upper endwall to the lower endwall, a second trailing edge extending from the upper endwall to the lower endwall axially offset from the second leading edge, a second pressure side wall extending from the second leading edge to the second trailing edge with a second concave shape and extending from the upper endwall to the lower endwall, a second suction side wall extending from the second leading edge to the second trailing edge with a second convex shape and extending from the upper endwall to the lower endwall, a second plurality of inner cooling apertures extending through the second pressure side wall and arranged in a third row extending between the second leading edge and the second trailing edge located radially outward from the lower endwall from three to seven times a third diameter of one of the second plurality of inner cooling apertures, and a second plurality of outer cooling apertures extending through the second pressure side wall and arranged in a fourth row extending between the second leading edge and the second trailing edge located radially inward from the upper endwall from three to seven times a fourth diameter of one of the second plurality of outer cooling apertures, a second plurality of showerhead cooling apertures extending through the second leading edge and arranged in a third group extending between the upper endwall and the lower endwall, each showerhead cooling aperture of the second plurality of showerhead cooling apertures including the showerhead compound angle from twenty to forty-five degrees, and a second plurality of angled cooling apertures extending through the second pressure side wall and arranged in a fourth group extending between the second plurality of inner cooling apertures and the second plurality of outer angled cooling apertures including the compound angle from fifteen to forty-five degrees, wherein the second plurality of showerhead cooling apertures and the second plurality of angled cooling apertures alternate in directionality such that the showerhead compound angle and the compound angle are in opposite radial directions.

13. The nozzle segment of claim 12, wherein the first row is parallel to the first lower endwall, the second row is parallel to the first upper endwall, the third row is parallel to the second lower endwall, and the fourth row is parallel to the second upper endwall.

14. The nozzle segment of claim 12, wherein each inner cooling aperture of the first plurality of inner cooling apertures and the second plurality of inner cooling apertures is spaced apart from an adjacent inner cooling aperture from three to five pitch over diameter and each outer cooling aperture of the first plurality of outer cooling apertures and the second plurality of outer cooling apertures is spaced apart from an adjacent outer cooling aperture from three to five pitch over diameter.

15. The nozzle segment of claim 12, wherein each inner cooling aperture of the first plurality of inner cooling apertures and the second plurality of inner cooling apertures, and each outer cooling aperture of the first plurality of outer cooling apertures and the second plurality of outer cooling apertures includes a diameter from 0.5 millimeters to 1.25 millimeters.

16. The nozzle segment of claim 12, wherein each inner cooling aperture of the first plurality of inner cooling apertures and the plurality of second inner cooling apertures, and each outer cooling aperture of the first plurality of outer cooling apertures and the second plurality of outer cooling apertures includes an injection angle from fifteen to fifty degrees.

17. The nozzle segment of claim 12, wherein the first plurality of inner cooling apertures includes from ten to thirty inner cooling apertures, the second plurality of inner cooling apertures includes from ten to thirty inner cooling apertures, the first plurality of outer cooling apertures includes from ten to thirty outer cooling apertures, and the second plurality of outer cooling apertures includes from ten to thirty outer cooling apertures.

18. The nozzle segment of claim 12, further comprising:

a first plurality of showerhead cooling apertures extending through the first leading edge and arranged in a first group extending between the upper endwall and the lower endwall;

a first plurality of angled cooling apertures extending through the first pressure side wall and arranged in a second group extending between the first plurality of inner cooling apertures and the first plurality of outer cooling apertures, each angled cooling aperture of the first plurality of angled cooling apertures including a compound angle from fifteen to forty-five degrees;

a second plurality of showerhead cooling apertures extending through the second leading edge and arranged in a third group extending between the upper endwall and the lower endwall; and a second plurality of angled cooling apertures extending through the second pressure side wall and arranged in a fourth group extending between the second plurality of inner cooling apertures and the second plurality of outer cooling apertures, each angled cooling aperture of the second plurality of angled cooling apertures including a compound angle from fifteen to forty-five degrees.

* * * * *